US010751854B2

(12) United States Patent
Zanni

(10) Patent No.: US 10,751,854 B2
(45) Date of Patent: Aug. 25, 2020

(54) DEVICE FOR LOCKING WORKPIECES ON MACHINE TOOLS

(71) Applicant: HYDROBLOCK S.R.L., Reggio Emilia (IT)

(72) Inventor: Davide Zanni, Reggio Emilia (IT)

(73) Assignee: Hydroblock S.r.l., Reggio Emilia (IT)

( * ) Notice: Subject to any disclaimer, the term of this patent is extended or adjusted under 35 U.S.C. 154(b) by 129 days.

(21) Appl. No.: 16/074,419

(22) PCT Filed: Mar. 24, 2017

(86) PCT No.: PCT/IB2017/051703
§ 371 (c)(1),
(2) Date: Jul. 31, 2018

(87) PCT Pub. No.: WO2017/163214
PCT Pub. Date: Sep. 28, 2017

(65) Prior Publication Data

US 2019/0030687 A1 Jan. 31, 2019

(30) Foreign Application Priority Data

Mar. 25, 2016 (IT) ..... UA2016A2578

(51) Int. Cl.
*B25B 5/12* (2006.01)
*B25B 5/06* (2006.01)

(52) U.S. Cl.
CPC ..... *B25B 5/062* (2013.01)

(58) Field of Classification Search
CPC .... B25B 1/00; B25B 1/14; B25B 5/00; B25B 5/02; B25B 5/12
See application file for complete search history.

(56) References Cited

U.S. PATENT DOCUMENTS 4,560,152 A * 12/1985 Miller ..... B25B 5/062 269/24
5,192,058 A * 3/1993 Vandalsem ..... B25B 5/061 269/24

(Continued)

FOREIGN PATENT DOCUMENTS

DE 3334401 A1 4/1985

OTHER PUBLICATIONS

International Search Report and Written Opinion dated Jul. 14, 2017 from International Patent Application No. PCT/IB2017/051703 filed Mar. 24, 2017.

*Primary Examiner* — Lee D Wilson
(74) *Attorney, Agent, or Firm* — David B. Tingey; Bryant J. Keller; Kirton McConkie

(57) ABSTRACT

The device (1) for locking workpieces on machine tools comprises: —a first hydraulic cylinder (2) inside which at least one piston (3, 4) is inserted slidably along a main line (A); —a second hydraulic cylinder (15) inside which the first hydraulic cylinder (2) is inserted slidably along the main line (A), the feeding of a pressurised hydraulic fluid into a first chamber (8) being designed to apply to the first hydraulic cylinder (2) a primary force (F) that shifts the first hydraulic cylinder (2) from a home position to a second operating position; —an auxiliary chamber (28) provided between the first hydraulic cylinder (2) and the second hydraulic cylinder (15) and associated with pneumatic feeding means (29, 30, 31) designed to feed pressurised air into the auxiliary chamber (28), the feeding of the pressurised air applying to the first hydraulic cylinder (2) an auxiliary force (Fa) along the main line (A) in the same direction as and operating in conjunction with the primary force (F).

12 Claims, 7 Drawing Sheets

(56) References Cited

U.S. PATENT DOCUMENTS

| | | | | |
|---|---|---|---|---|
| 5,695,177 | A * | 12/1997 | Mascola | B25B 5/062 269/20 |
| 2013/0334753 | A1* | 12/2013 | Stanifer | B23Q 3/069 269/32 |
| 2019/0030686 | A1* | 1/2019 | Zanni | B25B 5/166 |
| 2019/0030687 | A1* | 1/2019 | Zanni | B25B 5/062 |

* cited by examiner

DEVICE FOR LOCKING WORKPIECES ON MACHINE TOOLS

TECHNICAL FIELD

The present invention relates to a device for locking workpieces on machine tools.

BACKGROUND ART

As is known, in the mass production of mechanical workpieces that require machining to the machine tool, a robot brings the workpieces to be machined to a machine tool, where suitable means, of the hydraulic type, take over the workpiece and lock it in position to allow the machining thereof.

When machining has finished the aforementioned means release the machined workpiece, which is once again moved away by the robot.

One type of hydraulic means used for this purpose comprises a hydraulic device consisting essentially of a first cylinder in which a hollow piston is slidably inserted comprising a head and a coaxial rod the distal end of which projects from the cylinder.

The cavity in the piston is open only on the side of the piston head.

In this cavity a helical spring is inserted, one end of which rests at the closed end of the rod while the other end abuts on the inner end of a coaxial peg which starts from the closing element of the corresponding end of the first cylinder and is partly inserted in the same cavity.

The helical spring maintains the piston in its position in which the projection of the relative rod from the first cylinder (corresponding to the home condition of the hydraulic device) is maximal, in which position the piston head leans against an annular shoulder provided in the first cylinder.

By feeding pressurized oil to a first chamber partly delimited by the piston and for the remaining part by the inner surface of the first cylinder, the piston can be made to shift so as to move the rod backwards into the first cylinder.

In order for the backward movement of the rod to take place, the counteracting force of the aforementioned helical spring must be overcome.

Means are also provided to obtain, in addition to the backward movement of the rod, also the rotation thereof by a certain angle (rotation-translation).

These means comprise a pair of balls, partially projecting from relative seats provided in the piston head.

When the rod moves backwards, the piston head forces the balls to travel respective tracks formed symmetrically on the lateral surface of the aforementioned peg.

The pattern of the tracks is such that, when the pressurized oil is fed to the aforementioned first chamber, there is a first phase of backward movement and simultaneous rotation of the piston and therefore of the rod about their axis and a second phase of backward movement only of the rod (without rotation).

The device also comprises a second cylinder designed to receive slidably the first cylinder (which acts as a piston) from the second cylinder projecting outwards the end of the first cylinder from which the aforementioned rod projects, the maximum projection being limited by an end-of-stroke medium.

The second cylinder is fixed to a suitable support arranged in the proximity of the machine tool which must perform the machining of the workpiece. Continuing to feed pressurized oil to the aforementioned first chamber, the first cylinder, if it has not already reached the stroke end, tends to increase its projection from the second cylinder.

At this point it should be noticed that at the outer conical end of the rod is fixed, by means of a ring nut, an element projecting transversely to the rod, commonly called bracket, while another element projecting transversely, or counter-bracket, is fixed to the outer end of the first cylinder.

Therefore, when pressurized oil is fed to the aforementioned first chamber, the result is obtained (thanks to the aforementioned ball means and relative tracks) that the bracket approaches the end of the first cylinder in a first phase and at the same time rotates by an angle which allows the bracket to align with the counter-bracket (rotation-translation), while in a second phase (locking stroke) the bracket only approaches.

If between bracket and counter-bracket has been previously positioned a workpiece (carried by a robot and still retained by it) to be machined on the machine tool, following the feeding of pressurized oil to the aforementioned first chamber the bracket is in contact with the workpiece surface.

If pressurized oil is continuously fed to the first chamber, the further backward movement of the bracket being counteracted by the presence of the workpiece, the first cylinder automatically starts moving outwards, consequently approaching also the counter-bracket to the workpiece.

When also the counter-bracket is in contact with the workpiece, if oil is continuously fed, a pressure increase will be generated and therefore the force exerted by the bracket and counter-bracket on the workpiece.

When a predefined pressure value in the oil is achieved, a sequence valve, external to the device, opens the feeding procedure also to a chamber (hereinafter called third chamber) delimited partly by the inner surface of the second cylinder and for the remaining part by the outer surface of the first cylinder. In such a chamber there is, in contact with said outer surface, an elastic bushing, a part of which, rather thin, which surrounds the first cylinder, is deformed when the oil pressure achieves a value which allows to make it adhere to the surface of the first cylinder so as to develop friction forces that allow locking the first cylinder in position relative to the second cylinder.

On the locked workpiece, all the envisaged machining operations can now be performed.

Once these machining operations have been completed, the oil feeding line has to be drained off (so that in both the aforementioned chambers pressure drops to zero) not only to release the first cylinder, but also to automatically bring (thanks to the action of the aforementioned helical spring) the device back to its home position (maximum rod projection).

It should be noticed that the hydraulic device described above is of the single acting type, i.e. on the side of the piston head opposite to the rod there is a further chamber (which will be called hereinafter second chamber) in communication with the outside by means of a conventional vent.

The known hydraulic device described above, however, has a number of drawbacks.

In particular, since to move the rod backwards the force of the helical spring must be overcome which is enclosed in the cavity of the rod itself, it follows that the oil pressure fed to the first chamber can reach significant values (even 20 bars).

Pressure values of this magnitude cause the sealing gaskets to compress, which significantly increases the friction forces involved, with the result that the force exerted by the bracket and/or counter-bracket on the workpiece to be machined can be not negligible and cause excessive deformation of the workpiece (especially when it comes to thin pieces, which do not have an intrinsic strength), so as to discard the machined workpiece because it does not meet the required tolerances.

Another drawback is due to the fact that the helical spring contained in the hollow rod loses its initial characteristics of elasticity over time; therefore a periodical maintenance should be scheduled for the replacement of the spring, to avoid a reduction of the maximum opening (home position) between bracket and counter-bracket, with the risk that when the workpiece, after its machining, is removed by the robot, the workpiece itself may interfere with the bracket, be damaged and consequently being discarded.

Still a further drawback is due to the fact that the device described above is single-acting, i.e. that the aforementioned second chamber is in communication with the outside.

This communication can generate corrosion phenomena, as well as dirt and/or particles being present at the entrance of this chamber produced by the machining of the workpiece, which can alter the operation of the device.

The ideal situation for this type of device would be that the bracket and counter-bracket just brush the piece to be retained before the first cylinder is locked in position relative to the second cylinder, to prevent the forces exerted on the workpiece from deforming it, especially if the workpiece is not intrinsically strong.

To overcome at least partly the above mentioned drawbacks, the patent document IT 1391930 provides a hydraulic device for locking workpieces to be machined which is devoid of the aforementioned helical spring and which, due to the automatic return to the home condition, provides a suitable hydraulic operating medium.

In practice, instead of putting the aforementioned second chamber in communication with the outside (through a vent), in the device shown in patent document IT 1391930 an equivalent chamber (vent-free) is provided to which pressurized oil can be fed in order to bring the device back to its home condition.

A tight-sealing device is thus obtained with a double-acting hydraulic operation, in which the piston movement can be carried out with an oil pressure (for example 5 bar) which is considerably less than that (e.g. 20 bar) required by the known single-acting devices (in which the force must be overcome of the helical spring which counteracts the backward movement of the rod).

The device shown in IT 1391930 is also susceptible of further improvements.

It is noticed, in fact, that the reduction of the oil pressure inside the device causes the seals subjected to a lower pressure to generate considerably lower friction forces than known single-acting devices, but in any case of still not entirely negligible magnitude.

Such residual friction forces, in fact, counteract a resistance to the reciprocal shift of the rod relative to the first cylinder and of the first cylinder relative to the second cylinder and, seen that the movement of the counter-bracket fundamentally takes place when the presence of the workpiece prevents the bracket from further moving backwards, then it is easy to understand that the residual friction forces discharge mechanically on the workpiece in the form of reaction forces, with the risk of shifting/deforming it only for a few hundredths of a millimeter.

To these reaction forces induced by friction forces is added, if necessary, also the component of the weight force of the piston and of the first cylinder that, if e.g. arranged with a vertical axis, hang from the workpiece charging it with a force directed downwards.

DESCRIPTION OF THE INVENTION

The main aim of the present invention is to provide a device for locking workpieces on machine tools that enables the achievement of the above mentioned improvements and allows to stably lock a workpiece to be machined on a machine tool without charging it in any way from the tensional point of view and without deforming it.

Another object of the present invention is to provide a device for locking workpieces on machine tools which allows to overcome the mentioned drawbacks of the prior art within the ambit of a simple, rational, easy and effective to use as well as affordable solution.

The above mentioned objects are achieved by the present device for locking workpieces on machine tools having the characteristics of claim 1.

BRIEF DESCRIPTION OF THE DRAWINGS

Other characteristics and advantages of the present invention will become more evident from the description of a preferred, but not exclusive, embodiment of a device for locking workpieces on machine tools, illustrated by way of an indicative, but non-limiting example in the accompanying drawings, wherein.

EMBODIMENTS OF THE INVENTION

Figure 1:
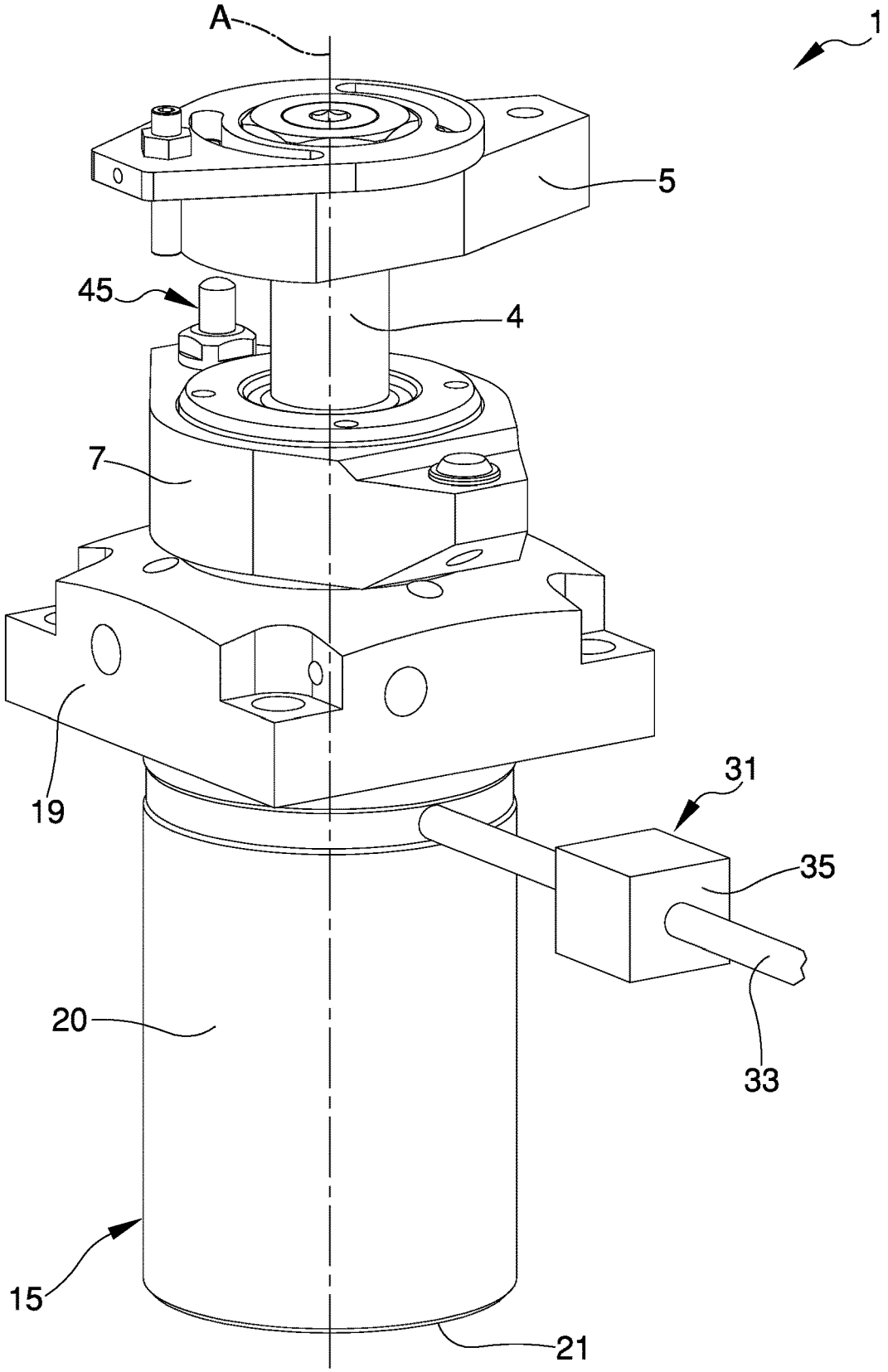
FIG. 1 is an axonometric view of the device according to the invention.
Figure 2:
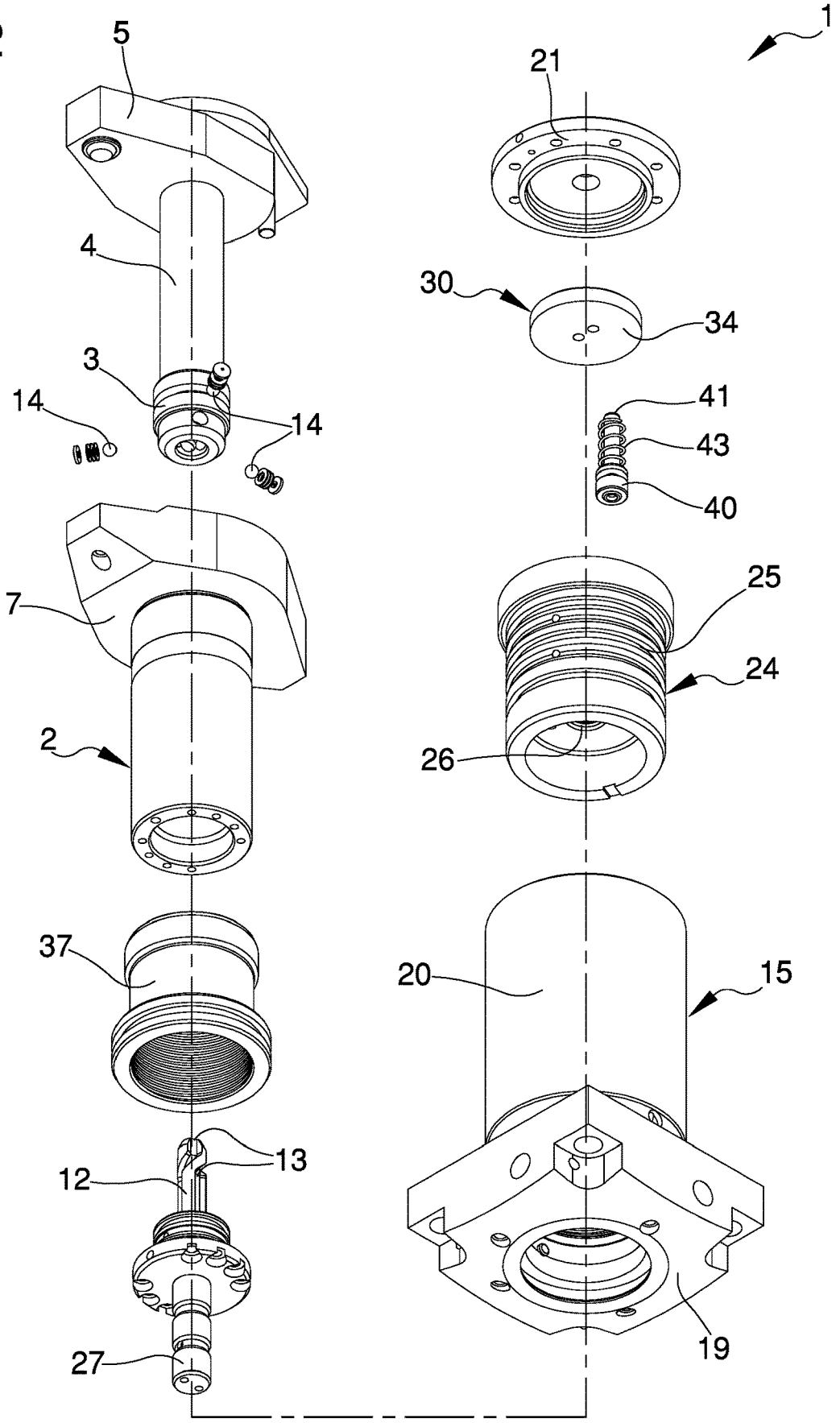
FIG. 2 is an exploded view of the device according to the invention.
Figure 3:
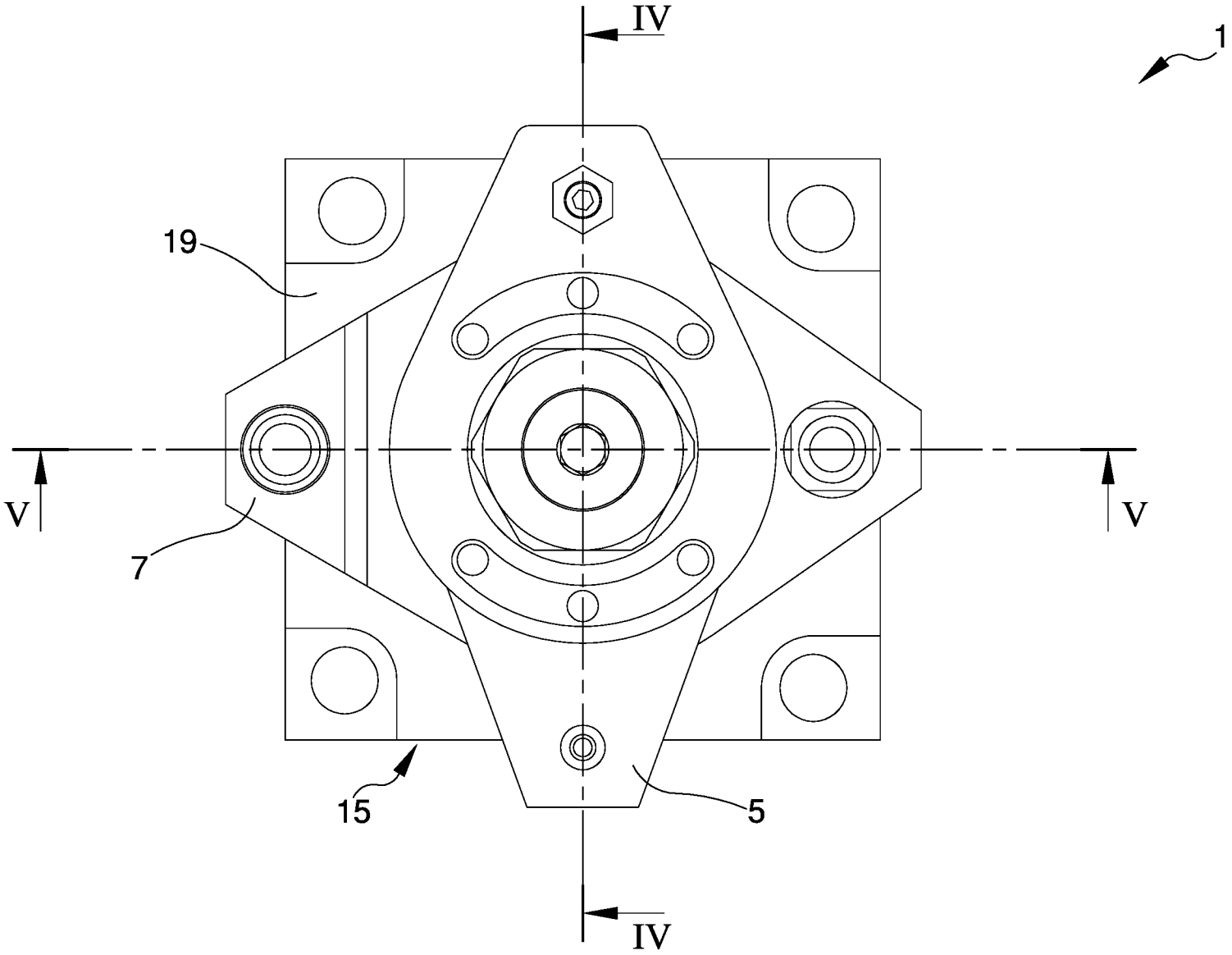
FIG. 3 is a top view of the device according to the invention.
Figure 4:
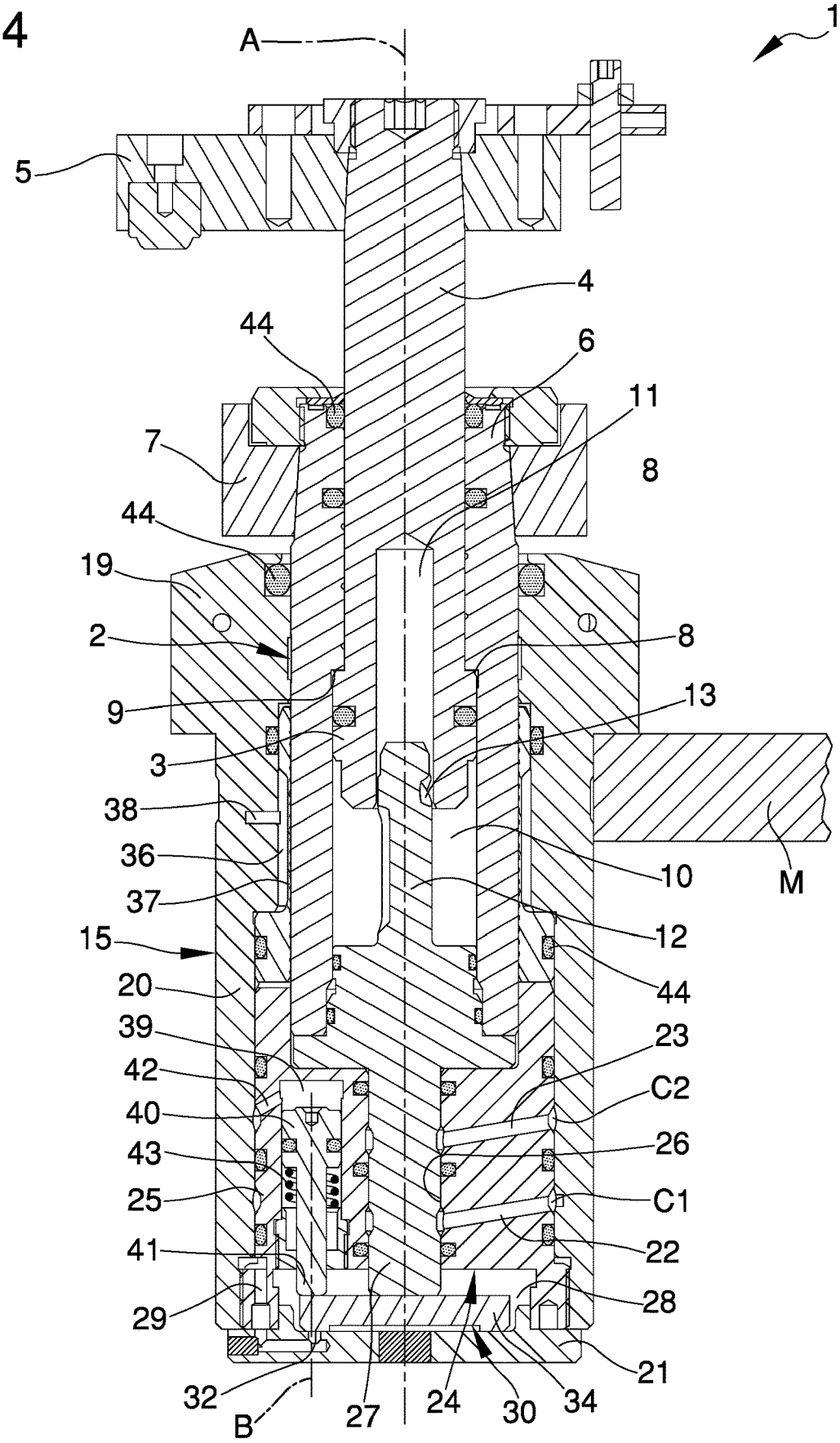
FIG. 4 is a sectional view of the device according to the invention along the plane IV-IV of FIG. 3.
Figure 5:
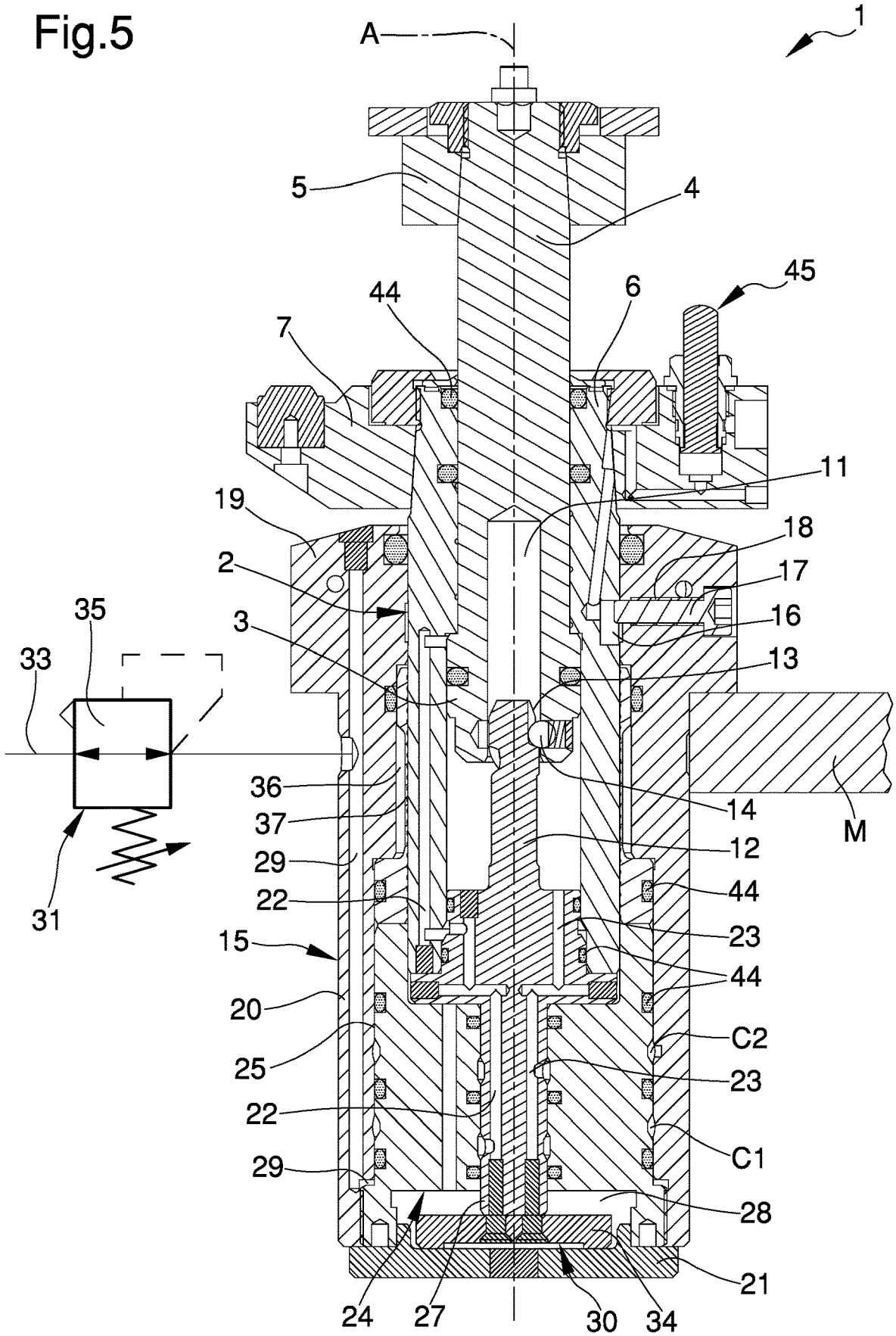
FIG. 5 is a sectional view of the device according to the invention along the plane V-V of FIG. 3, in which the rod and the first hydraulic cylinder are in the home position.

With particular reference to such figures, globally indicated with reference numeral 1 is a device for locking workpieces on machine tools.

The device 1 is particularly intended to lock at least a workpiece P after this has been placed in the proximity of a machine tool M and before starting the mechanical machining operation.

The device 1 comprises at least a first hydraulic cylinder 2 inside which at least one piston 3, 4 is inserted which can slide in both directions in the first hydraulic cylinder 2 along a main line A.

The piston 3, 4 comprises a head 3 and a rod 4.

Usefully, the head 3 and the rod 4 are made in a single body piece, i.e. in a single monolithic body, but alternative embodiments cannot be ruled out in which these are made in two or more separate pieces and assembled afterwards.

The rod 4 extends along the main line A and projects outside the first hydraulic cylinder 2; on the outer end of the rod 4 is fixed at least one transversal bracket 5.

Even the first hydraulic cylinder 2 extends along the main line A and has one end arranged in the proximity of the outer end of the rod 4 and which, by analogy, is called outer end 6 of the first hydraulic cylinder 2.

At the outer end 6 of the first hydraulic cylinder 2 is fixed a transversal counter-bracket 7, designed to operate in conjunction with the bracket 5 for receiving and locking the workpiece P.

The head 3 slides sealingly inside the inner surface of the first hydraulic cylinder 2. Between the first hydraulic cylinder 2 and the head 3 there is at least a first chamber 8 which can be fed with a pressurised hydraulic fluid to make the rod 4 move backwards starting from a first home position with maximum projection to a first operating position in which the bracket 5 is in contact with the workpiece P.

In the present discussion, by hydraulic fluid is meant any fluid in the liquid state (and therefore ideally incompressible) used as carrier medium for the transport of energy in a hydraulic circuit; preferably the hydraulic fluid consists in a traditional synthetic oil, but alternative embodiments cannot be ruled out in which it may be a mineral oil, vegetable oil, water or the like.

In the first home position, the head 3 is arranged in abutment against a shoulder 9 formed in the inner wall of the first hydraulic cylinder 2 and the first chamber 8 has practically no volume.

On the opposite side of the head 3 to the rod 4 there is at least a second chamber 10 which can be fed with a pressurized hydraulic fluid to return the rod 4 to the first home position; in other words, the first hydraulic cylinder 2 has a double-acting operation for the backward movement and hydraulic extraction of the piston 3, 4.

In the first home position the bracket 5 is not aligned with the counter-bracket 7 but rather it is rotated by a predefined angle.

Between the first hydraulic cylinder 2 and the piston 3, 4 are interposed rotating-translating means 11, 12, 13, 14 which, during a first step of backward movement of rod 4 from the first home position, cause it to rotate at the same time about the main line A by a predefined angle for bringing the bracket 5 into alignment with the counter-bracket 7, and which, during a second step of backward movement, cause it to slide along the main line A without rotating until it reaches the first operating position. The rotating-translating means 11, 12, 13, 14 comprise a coaxial blind hole 11, formed in the piston 3, 4, and a coaxial peg 12, which is joined to the first hydraulic cylinder 2, extends towards the inside of the second chamber 10 and is intended to remain at least partly inserted in the coaxial blind hole 11.

On the lateral surface of the coaxial peg 12 are formed three tracks 13, each of which is designed to partially receive a corresponding ball 14 for the remaining part enclosed in a corresponding cavity formed in the inner wall of the coaxial blind hole 11.

The tracks 13 extend, by a first stretch, along a substantially helical direction and, by a second stretch, along a substantially rectilinear direction and parallel to the main line A.

The assembly of the balls 14 and of the corresponding tracks 13 allows the piston 3, 4 to rotate and translate during the first phase of backward movement and to slide without rotation during the second phase of backward movement.

The device 1 comprises at least a second hydraulic cylinder 15 which is fixable to the machine tool M, and inside which the first hydraulic cylinder 2 is inserted.

The first hydraulic cylinder 2 can slide in both directions along the main line A, performing in turn the function of a piston.

Means comprising a slot 16 provided in the first hydraulic cylinder 2, in which enters the end of a pin 17 inserted in the second hydraulic cylinder 15, prevent the first hydraulic cylinder 2 from rotating with respect to the second hydraulic cylinder 15.

Usefully the pin 17 consists of a screw tightened into a threaded hole 18 formed in the wall of the second hydraulic cylinder 15.

The second hydraulic cylinder 15 comprises, e.g., a main block 19, which allows the fixing of the device 1 to the machine tool M, and a liner 20, which extends from the main block 19 along the main line A.

The main block 19 and the liner 20 are made in a single body piece, i.e. in a single monolithic body, but alternative embodiments cannot be ruled out in which these are made in two or more separate pieces and then assembled.

On the opposite side with respect to the main block 19, the liner 20 ends up in an open end which allows the introduction of the components inside the device 1 in the assembly phase and which is closable by means of a closing bottom 21 fixable to the liner 20.

To feed the pressurized hydraulic fluid inside the first chamber 8 and the second chamber 10 which are defined in the first hydraulic cylinder 2, a plurality of channels 22, 23 are provided, which are formed through the walls of the first hydraulic cylinder 2, of the second hydraulic cylinder 15 and of a distributor element 24 placed inside the liner 20 in the proximity of the closing bottom 21.

In use, the distributor element 24 does not move and is an integral part of the second hydraulic cylinder 15.

The channels 22, 23 are split into a number of first channels 22, which feed the pressurized hydraulic fluid inside the first chamber 8, and into a number of second channels 23, which feed the pressurized hydraulic fluid inside the second chamber 10.

The distributor element 24 is substantially annular and comprises an outer surface 25, associated with the inner wall of the liner 20, and a central hole 26, in which a part of the first hydraulic cylinder 2 is inserted.

In this regard it is underlined that the first hydraulic cylinder 2 comprises an inner end 27, opposite to the corresponding outer end 6, which is inserted from side to side in the central hole 26.

The distributor element 24, in practice, places the channels 22, 23 formed on the second hydraulic cylinder 15 in fluidic connection to the channels 22, 23 formed in the first hydraulic cylinder 2.

By means of a first inlet C1 associated with the first channels 22 and a second inlet C2 associated with the second channels 23, the channels themselves are connected to a conventional pump which feeds the hydraulic fluid in the device 1 by means of appropriate sequential valves.

When the rod 4 is in the first operating position, the further feeding of the pressurized hydraulic fluid into the first chamber 8 is designed to apply to the first hydraulic cylinder 2 a primary force F that shifts the first hydraulic cylinder 2 from a second home position, in which the first hydraulic cylinder 2 is mostly inserted in the second hydraulic cylinder 15, to a second operating position, in which the counter-bracket 7 is in contact with the workpiece P on the opposite side to the bracket 5.

The movement of the first hydraulic cylinder 2 from the second home position to the first home position is not obtained only thanks to the flow of the pressurized hydraulic fluid inside the first chamber 8.

Between the first hydraulic cylinder 2 and the second hydraulic cylinder 15, in fact, there is an auxiliary chamber 28 associated with pneumatic feeding means 29, 30, 31 designed to feed pressurised air into the auxiliary chamber 28 during the shift of the first hydraulic cylinder 2 from the second home position to the second operating position.

The feeding of pressurized air, in practice, applies to the first hydraulic cylinder 2 an auxiliary force Fa along the main line A which is in the same direction as and operates in conjunction with the primary force F.

The shift of the first hydraulic cylinder 2 from the second home position to the second operating position takes place, therefore, thanks to the combined effect of the primary force F and of the auxiliary force Fa.

Usefully, the auxiliary chamber 28 is at least partly made at the inner end 27 of the first hydraulic cylinder 2.

More in detail, the inner end 27 of the first hydraulic cylinder 2 and the auxiliary chamber 28 are arranged in the proximity of the closing bottom 21 and a first part of the auxiliary chamber 28 is delimited by the surfaces of the liner 20, of the closing bottom 21, of the distributor element 24 and of the inner end 27.

Usefully, a second part of the auxiliary chamber 28 extends from the opposite side relative to the distributor element 24 and is delimited by the surfaces of the distributor element 24 and of the first hydraulic cylinder 2.

The first and the second part of the auxiliary chamber 28 are placed in fluidic communication by means of a connection duct 46 formed through the distributor element 24.

Both the first part and the second part of the auxiliary chamber 28 define, on the first hydraulic cylinder 2, useful surfaces on which the pressurized air operates to generate the auxiliary force Fa.

The pneumatic feeding means 29, 30, 31 comprise at least one feeding duct 29 formed inside the second hydraulic cylinder 15 and ending up with an insertion mouth 32 formed at the auxiliary chamber 28.

In the particular embodiment shown in the figures, the feeding duct 29 passes through, in sequence, the liner 20, the distributor element 24 and the closing bottom 21, and the insertion mouth 32 is formed on the closing bottom 21.

The feeding duct 29 emerges from the liner 20 to be connected, by means of a pipe 33, to a compressed air source, such as a conventional electric compressor and/or the standard pneumatic supply network of the premises, or the like.

The pneumatic feeding means 29, 30, 31 also comprise detecting means 30 designed to detect that the first hydraulic cylinder 2 is in the second home position.

The detecting means 30 e.g. comprise:

- at least one portion 34 of the first hydraulic cylinder 2 which, in the second home position, closes the insertion mouth 32; and
- at least one sensing system designed to detect the closing of the insertion mouth 32 and of the feeding duct 29.

Usefully, the portion 34 consists of a plate associated with the inner end 27 of the first hydraulic cylinder 2 and which, in the second home position, abuts on the closing bottom 21 to obstruct the insertion mouth 32.

The sensing system (not shown in detail in the figures), on the other hand, consists in a system, the type of a pressure switch or the like, which, according to the change in the air pressure and/or its flow rate, is capable of learning whether the feeding duct 29 is obstructed or not and, since the occlusion takes place when the first hydraulic cylinder 2 is in the second home position, then the detecting means 30 are capable of detecting this second home position.

The detecting means 30 allow generating a control signal which can be interlocked to the management and control unit of the machine tool M; this way the management and control unit learns that the device 1 is placed in the release configuration of the workpiece P and can command the robot for moving the workpiece P for the loading and unloading of the same in complete safety.

The pneumatic feeding means 29, 30, 31 also comprise air pressure adjusting means 31, which are designed to adjust the magnitude of the auxiliary force Fa so as to at least partly compensate for:

- the friction forces existing between the piston 3, 4, the first hydraulic cylinder 2 and the second hydraulic cylinder 15; and
- the component of the weight force of the piston 3, 4 and of the first hydraulic cylinder 2 along the main line A.

In other words, the air pressure adjusting means 31, which for example consist of a regulating valve 35 located along the pipe 33 and manually adjustable, allow calibrating the triggering of the pneumatic feeding means 29, 30, 31 depending on the actual operating conditions of the device 1.

In fact, when setting the machine tool M, the operator performs one or more locking tests of the workpiece P by means of the device 1 and measures, e.g. by means of a micrometer dial gauge, how much the workpiece P shifts and/or deforms due to the forces that the bracket 5 and the counter-bracket 7 apply on it.

The shift and/or deformation of the workpiece P, which can only be a few hundredths of a millimeter, can be totally cleared thanks to the pneumatic feeding means 29, 30, 31; in practice, the operator manually adjusts the regulating valve 35 so as to change the air pressure, and consequently the auxiliary force Fa, as long as the shift of the workpiece P measured by the micrometer dial gauge gives a zero shift measurement, which corresponds to a situation in which the auxiliary force Fa perfectly compensates for the friction forces and the weight of the piston 3, 4 and of the first hydraulic cylinder 2, which could discharge on the workpiece P.

In this respect it is underlined that, unlike what happens for the primary force F, which is generated between the piston 3, 4 and the first hydraulic cylinder 2 due to the fact that the bracket 5 is already in contact with the workpiece P and, therefore, produces on the workpiece P reaction forces which tend to shift and/or deform it, the auxiliary force Fa is generated between the first hydraulic cylinder 2 and the second hydraulic cylinder 15 and does not produce any reaction force on the piston 3, 4.

In other words, the auxiliary force Fa is "external" to the workpiece P and can be set at the desired magnitude to compensate for the above mentioned reaction forces.

Once the bracket 5 and the counter-bracket 7 are respectively arranged in the first operating position and in the second operating position, the device 1 has to maintain the workpiece P stably locked to enable the machine tool M to perform the required mechanical machining operations.

For this purpose, between the first hydraulic cylinder 2 and the second hydraulic cylinder 15 are interposed temporary locking means 36, 37 designed to lock the first hydraulic cylinder 2 in the second operating position.

The temporary locking means 36, 37 comprise at least a third chamber 36 formed between the first hydraulic cylinder 2 and the second hydraulic cylinder 15 in which there is at least one elastic bushing 37 present in contact with the outer surface of the first hydraulic cylinder 2, the feeding of a pressurised hydraulic fluid into the third chamber 36 being designed to press the elastic bushing 37 against the first hydraulic cylinder 2 for generating friction forces capable of locking in position the first hydraulic cylinder 2 relative to the second hydraulic cylinder 15.

The third chamber 36 is formed in the inner wall of the second hydraulic cylinder 15 and the elastic bushing 37 housed inside it wraps substantially to measure the first hydraulic cylinder 2 and features a thinner portion so that, by feeding under pressure the hydraulic fluid in the third chamber 36, the thinner portion of the elastic bushing 37 is pressed against the first hydraulic cylinder 2.

If the pressure of the hydraulic fluid inside the third chamber 36 is sufficient, the first hydraulic cylinder 2 remains locked in place because of the friction forces that arise between the first hydraulic cylinder 2 and the elastic bushing 37, and it is possible to proceed with the machining of the workpiece P on board the machine tool M.

The feeding of the pressurized hydraulic fluid within the third chamber 36 is obtained by means of third channels 38 formed through the walls of the liner 20, which place the third chamber 36 in fluidic communication with the aforementioned pump.

The locking condition of the second hydraulic cylinder 15 can be usefully detected by means of a closing control valve 45, of a type per se known, which informs the management and control unit of the machine tool M that the device 1 is placed in the locking configuration of the workpiece P.

Once the mechanical machining operations on the workpiece P end up, the device 1 is able to go back to the starting configuration.

As said, the rod 4 is designed to go back to the first home position by virtue of the second chamber 10 which can be fed with the pressurized hydraulic fluid, so as to move the bracket 5 away from the machined workpiece P.

To move also the counter-bracket 7 away, the device 1 comprises hydraulic return means 39, 40, 41, 42, 43 designed to return the first hydraulic cylinder 2 to the second home position.

The hydraulic return means 39, 40, 41, 42, 43 comprise at least one seat 39 made in the second hydraulic cylinder 15, particularly in the distributor element 24 which, as said, is part of the second hydraulic cylinder 15.

In the seat 39 at least one actuating pin 40, 41 is inserted slidably along a secondary line B.

The seat 39 can be fed with the pressurised hydraulic fluid for shifting the actuating pin 40, 41 along the secondary line B and pushing the first hydraulic cylinder 2 towards the second home position.

The actuating pin 40, 41 comprises a first end 40 facing the seat 39 and a second end 41 opposite to the first end 40 which is positioned inside the auxiliary chamber 28 and in contact against the portion 34 of the first hydraulic cylinder 2.

The hydraulic return means 39, 40, 41, 42, 43 comprise:

at least one connecting channel 42 connecting the seat 39 to the second chamber 10, the seat 39 and the second chamber 10 being feedable with the same hydraulic fluid coming from the second inlet C2; and at least one elastic element 43 for opposing the shifting of the actuating pin 40, 41 and calibrated to delay the shifting of the actuating pin 40, 41 so that the return of the rod 4 to the first home position occurs before the return of the first hydraulic cylinder 2 to the second home position.

In practice, when the hydraulic fluid is fed at the second inlet C2, the pressure of same insists both on the head 3 inside the second chamber 10 and on the actuating pin 40, 41 inside the seat 39.

As long as the pressure of the hydraulic fluid remains below the calibration value of the elastic element 43, the hydraulic fluid only flows inside the second chamber 10 by shifting the rod 4 from the first operating position to the second operating position.

When the head 3 reaches the shoulder 9, then the pressure of the hydraulic fluid increases and reaches the calibration value of the elastic element 43 and overcomes the elastic force of the same.

This way the actuating pin 40, 41 shifts to the seat 39 along the secondary line B and pushes the portion 34 towards the initial configuration so as to bring the first hydraulic cylinder 2 back to the second home position.

Usefully, the secondary line B is straight and parallel to the main line A.

It cannot however be ruled out that the sliding of the actuating pin 40, 41 can also take place along a curvilinear or oblique trajectory (i.e. neither orthogonal nor parallel) with respect to the main line A, so as to have at least one shifting component parallel to the main line A.

The device 1, as has been described and illustrated, has several parts in contact with the pressurized hydraulic fluid and, therefore, suitable seals are provided arranged at different points of the device 1 which, for simplicity of representation, are commonly identified with reference numeral 44.

The operation of the present invention is as follows.

Figure 6:
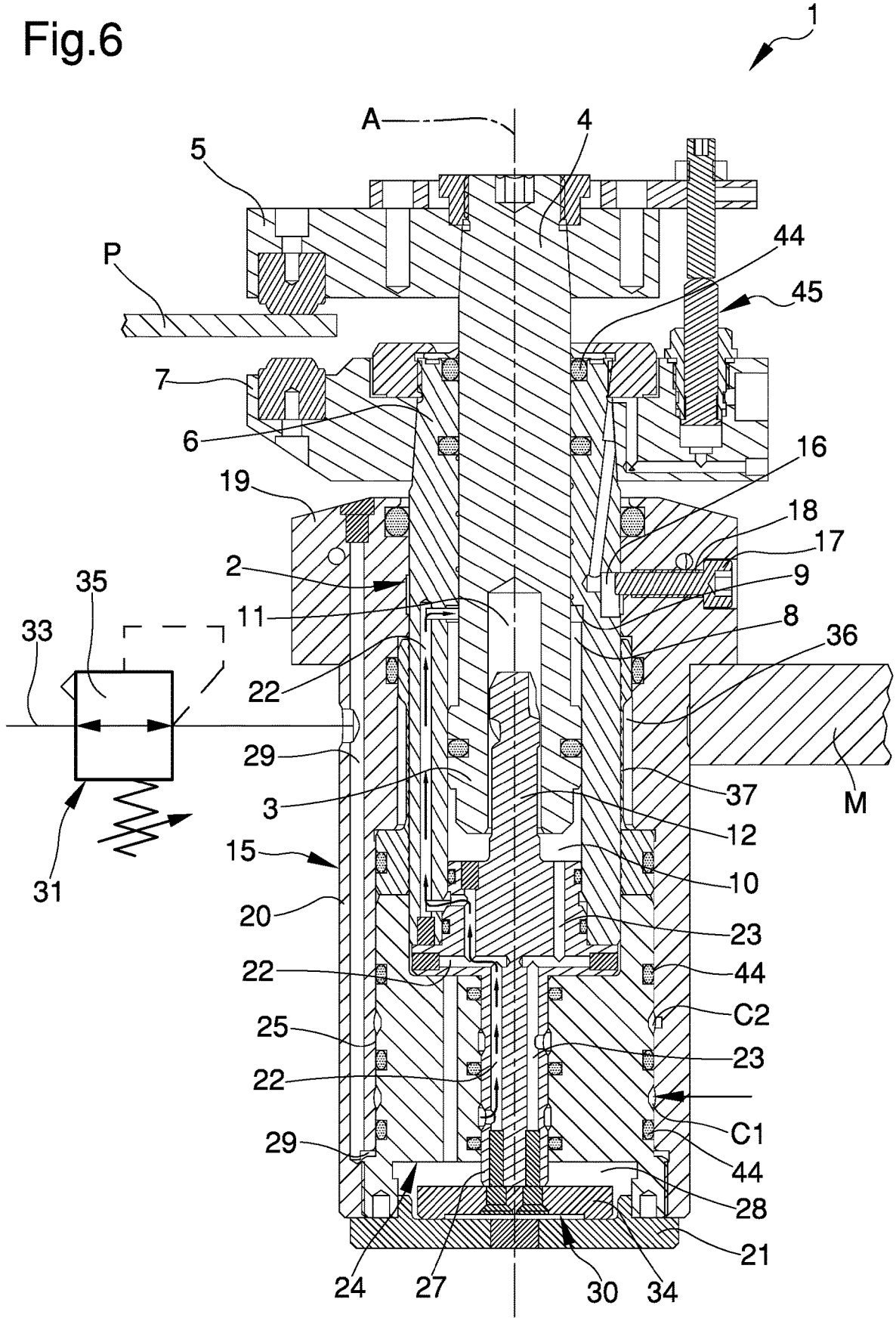
FIG. 6 is a sectional view of the device according to the invention along the same plane of FIG. 5, in which the rod is in the operating position and the first hydraulic cylinder is in the home position.
Figure 7:
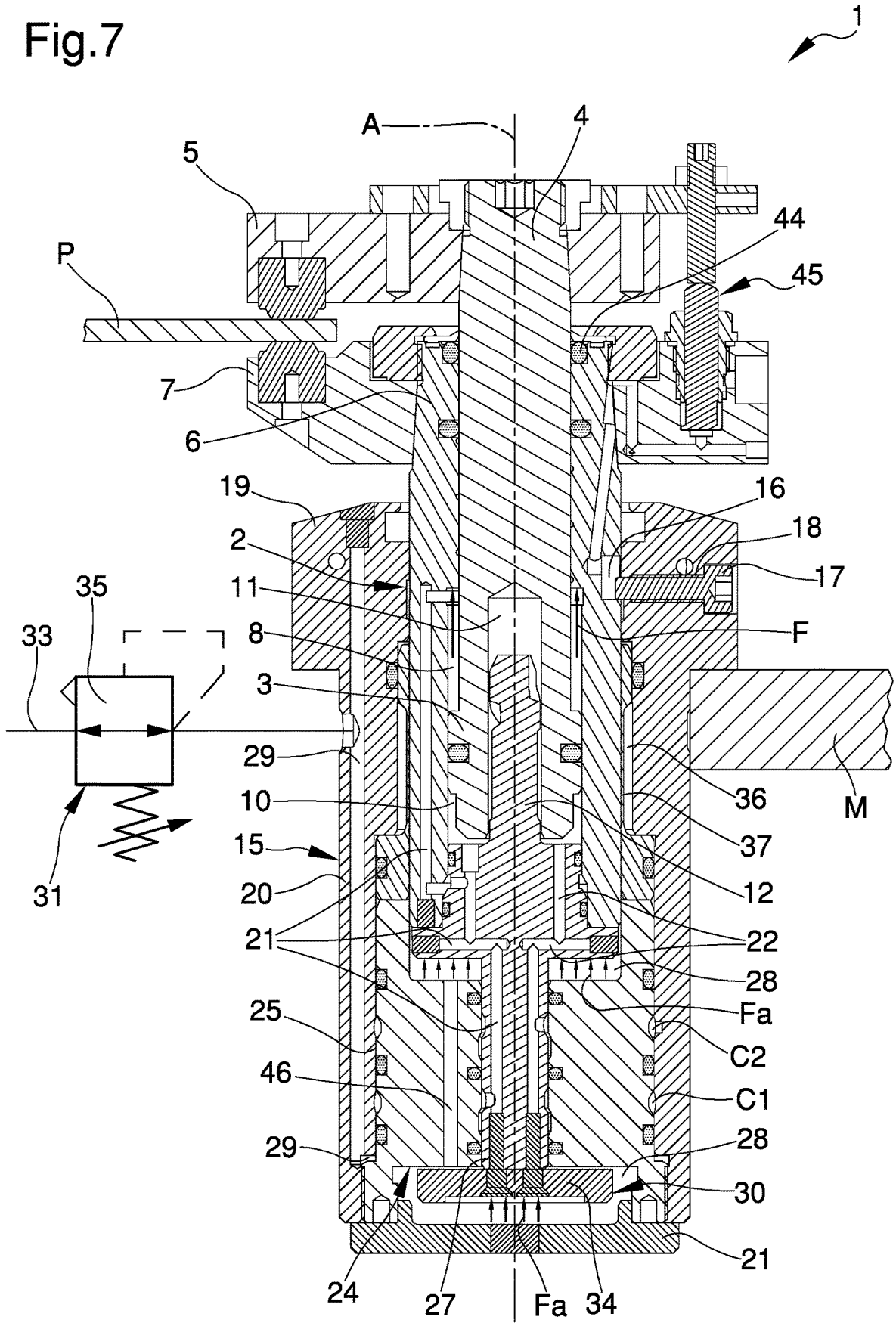
FIG. 7 is a sectional view of the device according to the invention along the same plane of FIG. 5, in which the rod and the first hydraulic cylinder are in the operating position.

Beginning from the starting condition, in which the rod 4 is placed in the first home position and the first hydraulic cylinder 2 is placed in the second home position, and feeding the pressurized hydraulic fluid at the first inlet C1 (FIG. 6), the same flows through the first channels 22 up to the first chamber 8 and pushes the head 3 and the rod 4 to move backwards.

As already said, in its backward stroke the rod 4 is initially moved backwards and rotated at the same time, to be then moved backwards only until the bracket 5 touches the workpiece P.

By continuing to feed the pressurized hydraulic fluid at the first inlet C1 and at the same time feeding air from the pipe 33, it follows that the first hydraulic cylinder 2 begins to move along the main line A until also the counter-bracket 7 touches the workpiece P.

At this point it should be noticed that if the workpiece P, normally positioned by a robot, is already in contact with the counter-bracket 7, the latter does not shift and only the bracket 5 approaches the workpiece P.

Resuming the description of the operation of the device 1, when the hydraulic fluid in the first chamber 8 exceeds a predefined pressure value, a sequential valve (not visible in the figures because of conventional type) allows feeding the hydraulic fluid to the third channels 38 to pressurize the third chamber 36, so that the thinnest part of the elastic bushing 37 is pressed against the outer wall of the first hydraulic cylinder 2, locking it in position while the mechanical machining operation of the workpiece P takes place on the machine tool M.

Once this machining operation has finished and after draining the line that feeds the pressurized hydraulic fluid at the first inlet C1 and at the third channels 38, the pressurized hydraulic fluid starts to be fed at the second inlet C2 and then at the second chamber 10, thus causing the shift of the head 3 and of the rod 4 from the first operating position to the first home position.

As has already been said, when the head 3 reaches the shoulder 9 the hydraulic fluid begins to flow in the seat 39 and also brings the first hydraulic cylinder 2 back to the second home position (the operating cycle thus being completed).

The invention claimed is:

1. A device for locking workpieces on machine tools, comprising:

at least one first hydraulic cylinder inside which at least one piston is inserted slidably along a main line, the piston comprising a head and a rod that projects from said first hydraulic cylinder, wherein:

fixed on an outer end of said rod there is at least one transversal bracket;

fixed on an outer end of said first hydraulic cylinder there is a transversal counter-bracket configured to operate in conjunction with said transversal bracket for receiving and locking said workpiece;

between said first hydraulic cylinder and said head there is at least one first chamber which can be fed with pressurised hydraulic fluid to make said rod move backwards starting from a first home position with maximum projection to a first operating position in which said bracket is in contact with at least one workpiece to be worked on a machine tool;

on an opposite side of said head to said rod there is at least one second chamber which can be fed with pressurised hydraulic fluid to return said rod to said first home position;

rotating-translating means interposed between said first hydraulic cylinder and said piston which, during a first step of rod backward movement from said first home position, simultaneously cause said rod to rotate about said main line by a predetermined angle for bringing said bracket into alignment with said counter-bracket, and which, during a second step of backward movement, cause said rod to slide along said main line without rotating until said rod reaches said first operating position;

at least one second hydraulic cylinder which is fixable to said machine tool and inside which said first hydraulic cylinder is inserted slidably along said main line, the feeding of pressurised hydraulic fluid into said first chamber, when said rod is in said first operating position, being configured to apply to said first hydraulic cylinder a primary force that shifts said first hydraulic cylinder from a second home position, in which said first hydraulic cylinder is mostly inserted in said second hydraulic cylinder, to a second operating position, in which said counter-bracket is in contact with said workpiece on the opposite side to said bracket; and temporary locking means interposed between said first hydraulic cylinder and said second hydraulic cylinder and configured to lock said first hydraulic cylinder in said second operating position;

wherein between said first hydraulic cylinder and said second hydraulic cylinder there is an auxiliary chamber associated with pneumatic feeding means configured to feed pressurised air into said auxiliary chamber during shifting of said first hydraulic cylinder from said second home position to said second operating position, the feeding of said pressurised air applying to said first hydraulic cylinder an auxiliary force along said main line in a same direction as and operating in conjunction with said primary force.

2. The device according to claim 1, wherein said first hydraulic cylinder comprises an inner end opposite to the corresponding outer end of the first hydraulic cylinder, said auxiliary chamber being at least partly made at said inner end.

3. The device according to claim 1, wherein said pneumatic feeding means comprise adjusting means for adjusting an air pressure, configured to adjust an amount of said auxiliary force so as to at least partly compensate for:

friction forces existing between said piston, said first hydraulic cylinder and said second hydraulic cylinder; and a component of the weight force of said piston and of said first hydraulic cylinder along said main line.

4. The device according to claim 1, wherein said pneumatic feeding means comprise at least one feeding duct made in said second hydraulic cylinder and ending with an insertion mouth at said auxiliary chamber.

5. The device according to claim 1, wherein said pneumatic feeding means comprise detecting means for detecting said first hydraulic cylinder in said second home position.

6. The device according to claim 4, wherein said pneumatic feeding means comprise detecting means for detecting said first hydraulic cylinder in said second home position, said detecting means comprising:

at least one portion of said first hydraulic cylinder which, in said second home position, closes said insertion mouth; and at least one sensing system configured to detect a closing of said insertion mouth and of said feeding duct.

7. The device according to claim 1, wherein said device comprises hydraulic return means configured to return said first hydraulic cylinder to said second home position.

8. The device according to claim 7, wherein said hydraulic return means comprise at least one seat made in said second hydraulic cylinder in which at least one actuating pin is inserted slidably along a secondary line, said seat being feedable with pressurised hydraulic fluid for shifting said actuating pin along said secondary line and pushing said first hydraulic cylinder towards said second home position.

9. The device according to claim 6, wherein:

said device comprises hydraulic return means configured to return said first hydraulic cylinder to said second home position;

said hydraulic return means comprise at least one seat made in said second hydraulic cylinder in which at least one actuating pin is inserted slidably along a secondary line, said seat being feedable with pressurised hydraulic fluid for shifting said actuating pin along said secondary line and pushing said first hydraulic cylinder towards said second home position; and said actuating pin comprises a first end facing said seat and a second end opposite to said first end which is positioned inside said auxiliary chamber and in contact against said portion of the first hydraulic cylinder.

10. The device according to claim 8, wherein said hydraulic return means comprise:

at least one connecting channel connecting said seat to said second chamber, which can be fed with the same hydraulic fluid; and at least one elastic element for opposing the shifting of said actuating pin and calibrated to delay the shifting of said actuating pin so that the return of said rod to said first home position occurs before the return of said first hydraulic cylinder to said second home position.

11. The device according to claim 8, wherein said secondary line is parallel to said main line.

12. The device according to claim 8, wherein said temporary locking means comprise at least one third chamber formed between said first hydraulic cylinder and said second hydraulic cylinder in which there is at least one elastic bushing present in contact with the outer surface of said first hydraulic cylinder, the feeding of pressurised hydraulic fluid into said third chamber being configured to press said elastic bushing against said first hydraulic cylinder for generating friction forces able to lock in position said first hydraulic cylinder relative to said second hydraulic cylinder.

* * * * *